US010982412B2

(12) United States Patent
Boyd et al.

(10) Patent No.: US 10,982,412 B2
(45) Date of Patent: Apr. 20, 2021

(54) HYDRAULIC SYSTEM FOR WORKING MACHINE AND THE WORKING MACHINE

(71) Applicant: KUBOTA CORPORATION, Osaka (JP)

(72) Inventors: Robert Stewart Boyd, Jefferson, GA (US); Kosuke Oyama, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/899,983

(22) Filed: Jun. 12, 2020

(65) Prior Publication Data

US 2020/0407944 A1 Dec. 31, 2020

(30) Foreign Application Priority Data

Jun. 28, 2019 (JP) ..... JP2019-122528

(51) Int. Cl.

| | |
|---|---|
| ***E02F 9/22*** | (2006.01) |
| ***F15B 13/06*** | (2006.01) |
| ***F15B 13/02*** | (2006.01) |
| *E02F 9/20* | (2006.01) |

(52) U.S. Cl.

CPC ..... *E02F 9/2203* (2013.01); *E02F 9/2225* (2013.01); *E02F 9/2267* (2013.01); *F15B 13/024* (2013.01); *F15B 13/06* (2013.01); *E02F 9/2033* (2013.01); *E02F 9/2271* (2013.01); *E02F 9/2282* (2013.01)

(58) Field of Classification Search

CPC ..... E02F 9/2033; E02F 9/2203; E02F 9/2225; E02F 9/2271; E02F 9/2282; F15B 11/22; F15B 13/024; F15B 13/06

See application file for complete search history.

(56) References Cited

U.S. PATENT DOCUMENTS 3,175,580 A * 3/1965 Krehbiel ..... F15B 13/06 137/596.12
3,181,430 A * 5/1965 Freedy ..... E02F 9/2271 91/518
3,262,467 A * 7/1966 Stacey ..... E02F 9/226 137/596.2

(Continued)

FOREIGN PATENT DOCUMENTS

JP 5114132 B2 1/2013

*Primary Examiner* — Abiy Teka
*Assistant Examiner* — Matthew Wiblin
(74) *Attorney, Agent, or Firm* — Greenblum & Bernstein, P.L.C.

(57) ABSTRACT

A hydraulic system includes: a boom cylinder; a working tool cylinder; a boom control valve; a working tool control valve; first and second fluid tubes through which operation fluid is supplied to the boom cylinder; third and fourth fluid tubes through which operation fluid is supplied to the working tool cylinder; a first relief valve provided in a first bypass fluid tube and configured to allow the operation fluid to flow from the fourth fluid tube toward the first fluid tube and to block the operation fluid flowing from the first fluid tube toward the fourth fluid tube; and a second relief valve provided in a second bypass fluid tube and configured to allow the operation fluid to flow from the third fluid tube toward the second fluid tube and to block the operation fluid flowing from the second fluid tube toward the third fluid tube.

14 Claims, 7 Drawing Sheets

(56) References Cited

U.S. PATENT DOCUMENTS

| | | | | | |
|---|---|---|---|---|---|
| 3,633,617 | A * | 1/1972 | Stacey | ..... | F15B 13/06<br>60/426 |
| 4,335,992 | A * | 6/1982 | Reeves | ..... | B66F 9/146<br>414/667 |
| 2012/0251285 | A1* | 10/2012 | Oyama | ..... | E02F 3/627<br>414/722 |
| 2019/0010966 | A1* | 1/2019 | Bellows | ..... | F15B 11/20 |

* cited by examiner

HYDRAULIC SYSTEM FOR WORKING MACHINE AND THE WORKING MACHINE

CROSS-REFERENCE TO RELATED APPLICATIONS

The present application claims priority under 35 U.S.C. § 119 to Japanese Patent Application No. P2019-122528, filed Jun. 28, 2019. The content of this application is incorporated herein by reference in their entirety.

BACKGROUND OF THE INVENTION

Field of the Invention

The present invention relates to a hydraulic system for a working machine having a boom and a working tool.

Description of Related Art

A front loader disclosed in Japanese Patent Publication No. 5114132 is previously known. The front loader disclosed in Japanese Patent Publication No. 5114132 includes a boom pivotally supported at a front portion of a working machine (a tractor), a bucket pivotally supported at a tip end of the boom, a synchronous portion to move in synchronization with the scooping operation and dumpling operation of the bucket, a bell crank supported rotatably around the support shaft of the boom, and a mechanism configured to hold the posture of the bucket to prevent the contents stored in the bucket from falling when the boom is moved up and down. The mechanism has a plurality of link members extending along the boom, and the link members connect the synchronous portion and the bell crank.

SUMMARY OF THE INVENTION

A hydraulic system for a working machine, includes: a boom cylinder to move a boom upward and downward; a working tool cylinder to move a working tool attached to the boom; a boom control valve configured to change a position of the boom cylinder between a lifting position to allow the boom to be lifted and a lowering position to allow the boom to be lowered; a working tool control valve configured to change a position of the working tool cylinder between a first moving position to allow a first movement of the working tool and a second moving position to allow a second movement of the working tool; a first fluid tube through which operation fluid is supplied to and discharged from the boom cylinder when the boom control valve is at the lifting position and at the lowering position; a second fluid tube through which operation fluid is supplied to and discharged from the boom cylinder when the boom control valve is at the lifting position and at the lowering position; a third fluid tube through which operation fluid is supplied to and discharged from the working tool cylinder when the working tool control valve is at the first moving position and at the second moving position; a fourth fluid tube through which operation fluid is supplied to and discharged from the working tool cylinder when the working tool control valve is at the first moving position and at the second moving position; a first bypass fluid tube connecting the first fluid tube and the fourth fluid tube; a second bypass fluid tube connecting the second fluid tube and the third fluid tube; a first relief valve provided in the first bypass fluid tube and configured to allow the operation fluid to flow from the fourth fluid tube toward the first fluid tube and to block the operation fluid flowing from the first fluid tube toward the fourth fluid tube; and a second relief valve provided in the second bypass fluid tube and configured to allow the operation fluid to flow from the third fluid tube toward the second fluid tube and to block the operation fluid flowing from the second fluid tube toward the third fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
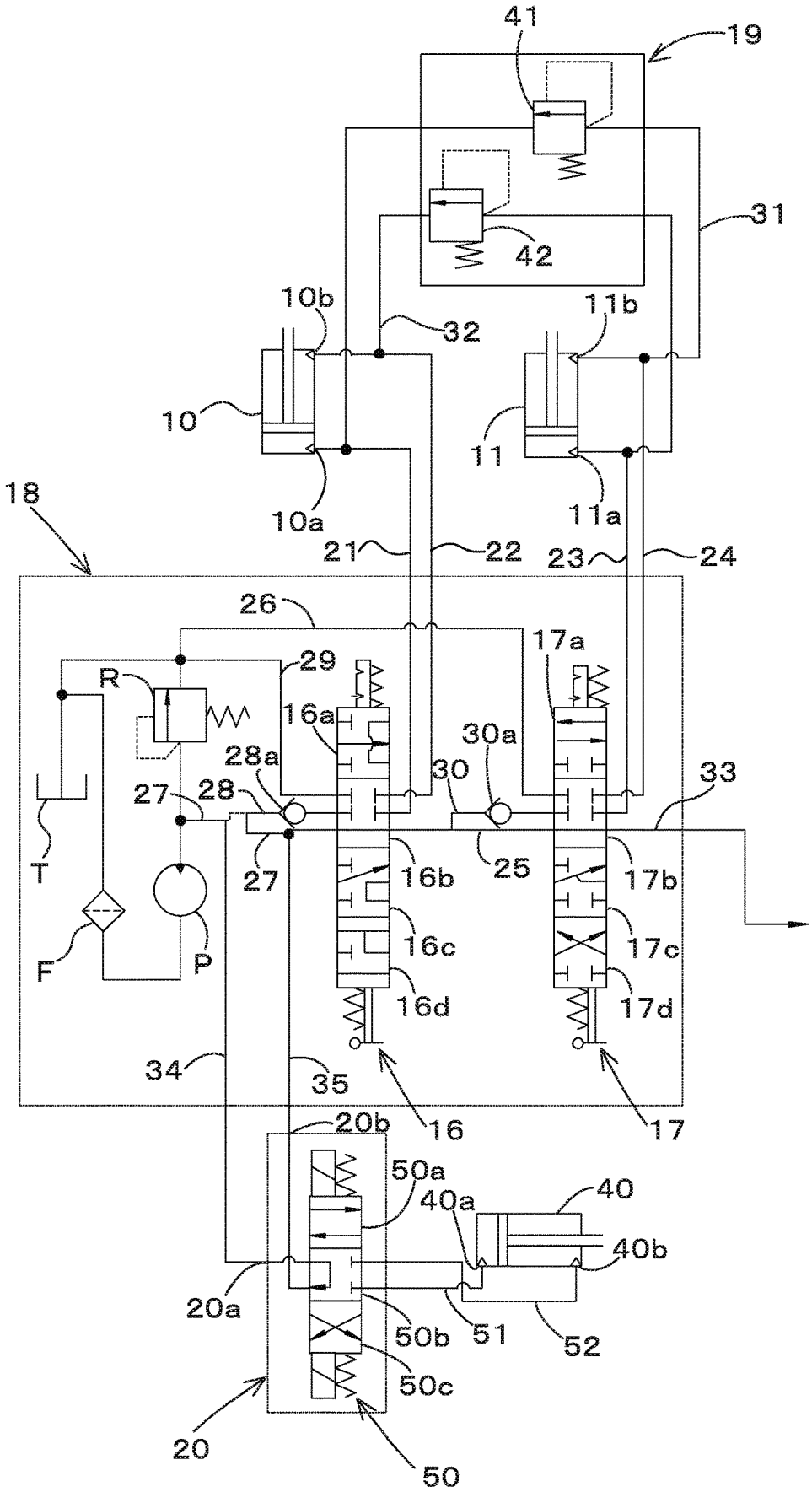
FIG. 1 is a view illustrating a circuit diagram of a hydraulic system (a hydraulic circuit) for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, embodiments of the present invention will be described with reference to the drawings.

Figure 7:
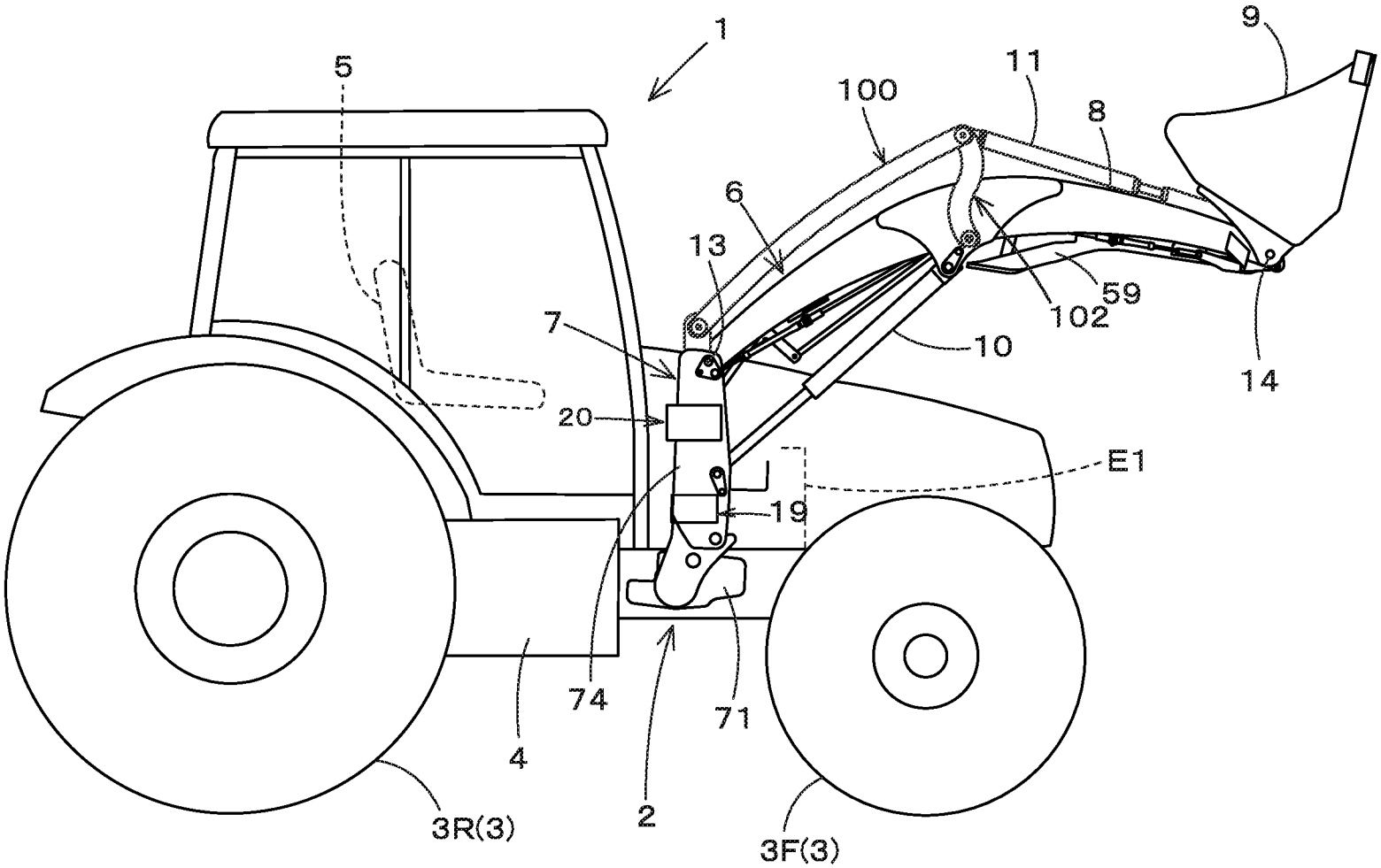
FIG. 7 is a side view of the working machine according to the embodiment.

FIG. 7 is a side view showing an embodiment of a working machine 1. In the present embodiment, the working machine 1 is a tractor. However, the working machine 1 is not limited to a tractor, and may be another type of working machine (a working vehicle).

In the following description, the front side of the operator sitting on an operator seat 5 of the tractor (the working vehicle) 1 is referred to as the front, the rear side of the operator is referred to as the rear, the left side of the operator is referred to as the left, and the right side of the operator is referred to as the right. In addition, the horizontal direction, which is a direction orthogonal to the front-rear direction of the working vehicle 1, will be described as a vehicle width direction.

In addition, a direction corresponding to the vehicle width direction and separating away from the center in the vehicle width direction will be described as a vehicle outward direction (a vehicle outward side), and a direction corresponding to the vehicle width direction and approaching the center in the vehicle width direction will be described as a vehicle inward direction (a vehicle inward side).

The tractor 1 includes a vehicle body 2 and a traveling device 3.

An operator seat 5 is provided to an upper portion of the vehicle body 2. An engine E1 is mounted on a front portion of the vehicle body 2. A clutch housing, a transmission case 4, and the like are provided at the rear portion of the vehicle body 2. The traveling device 3 includes a front wheel 3F provided at the front portion of the vehicle body 2 and includes a rear wheel 3R provided at the rear portion of the vehicle body 2.

A front loader 6 is attached to the vehicle body 2. The front loader 6 is supported by the front portion of the vehicle body 2. Hereinafter, the front loader 6 will be described below.

Figure 2:
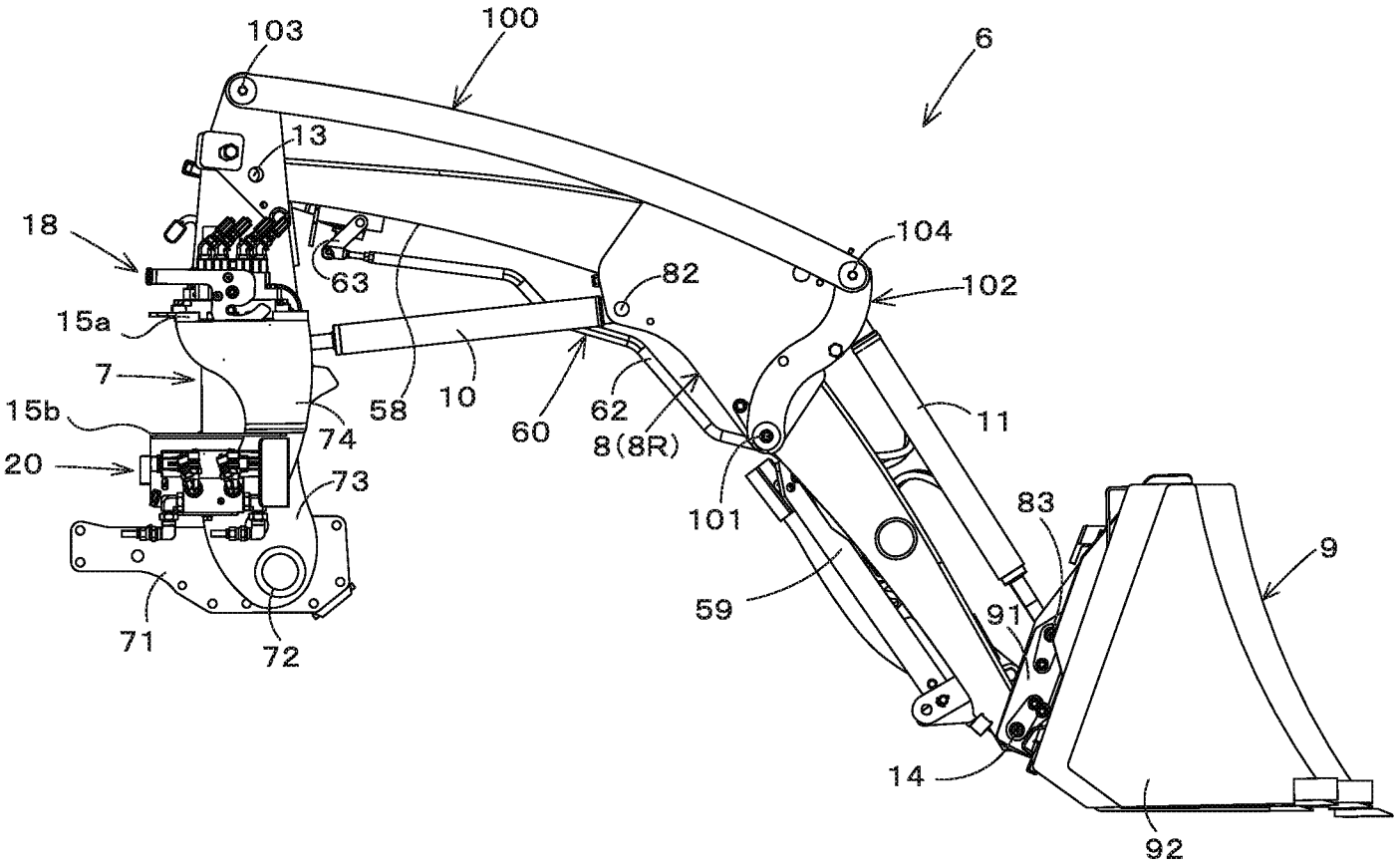
FIG. 2 is a side view of a front loader according to the embodiment.
Figure 3:
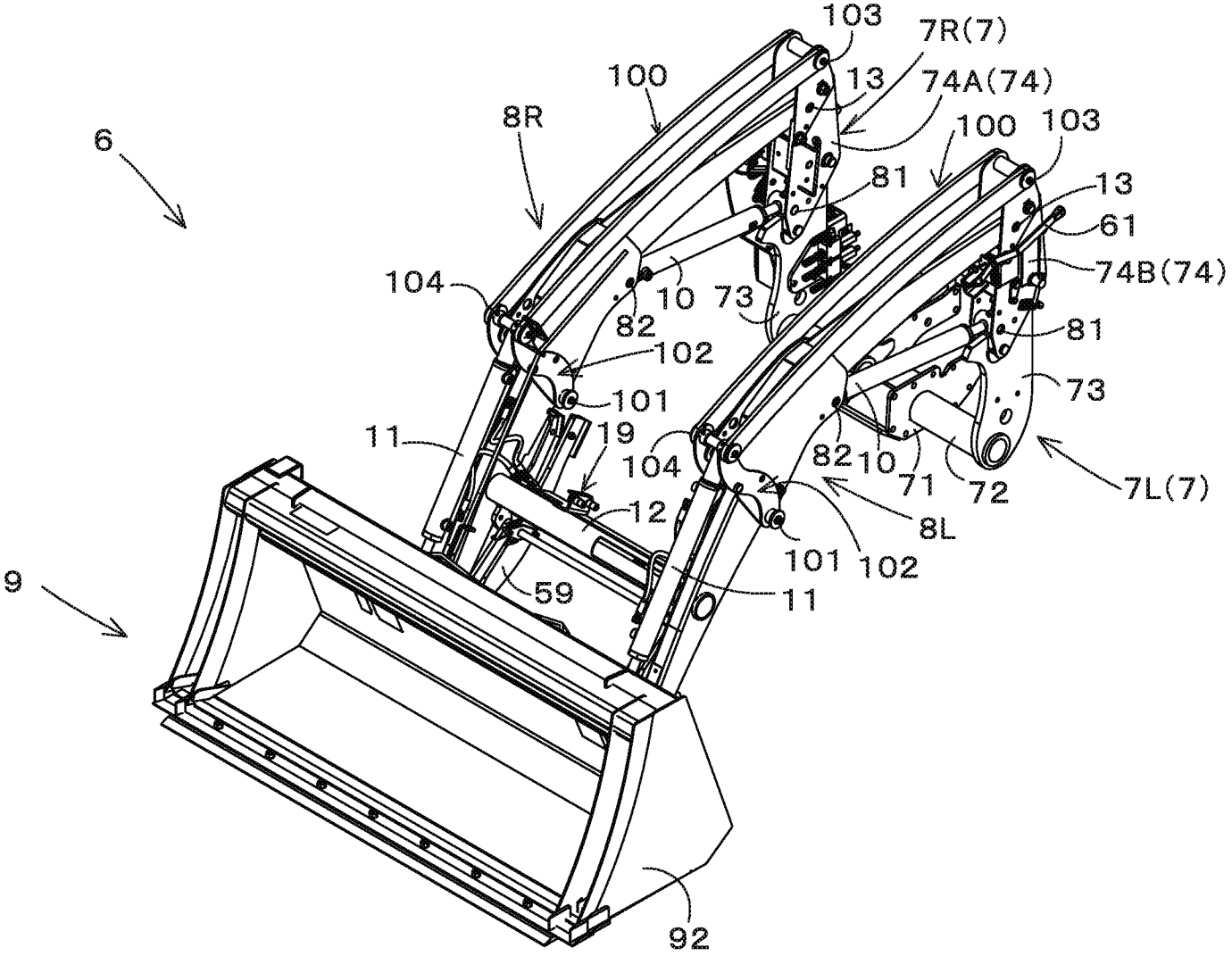
FIG. 3 is a perspective view of the front loader according to the embodiment.
Figure 4:
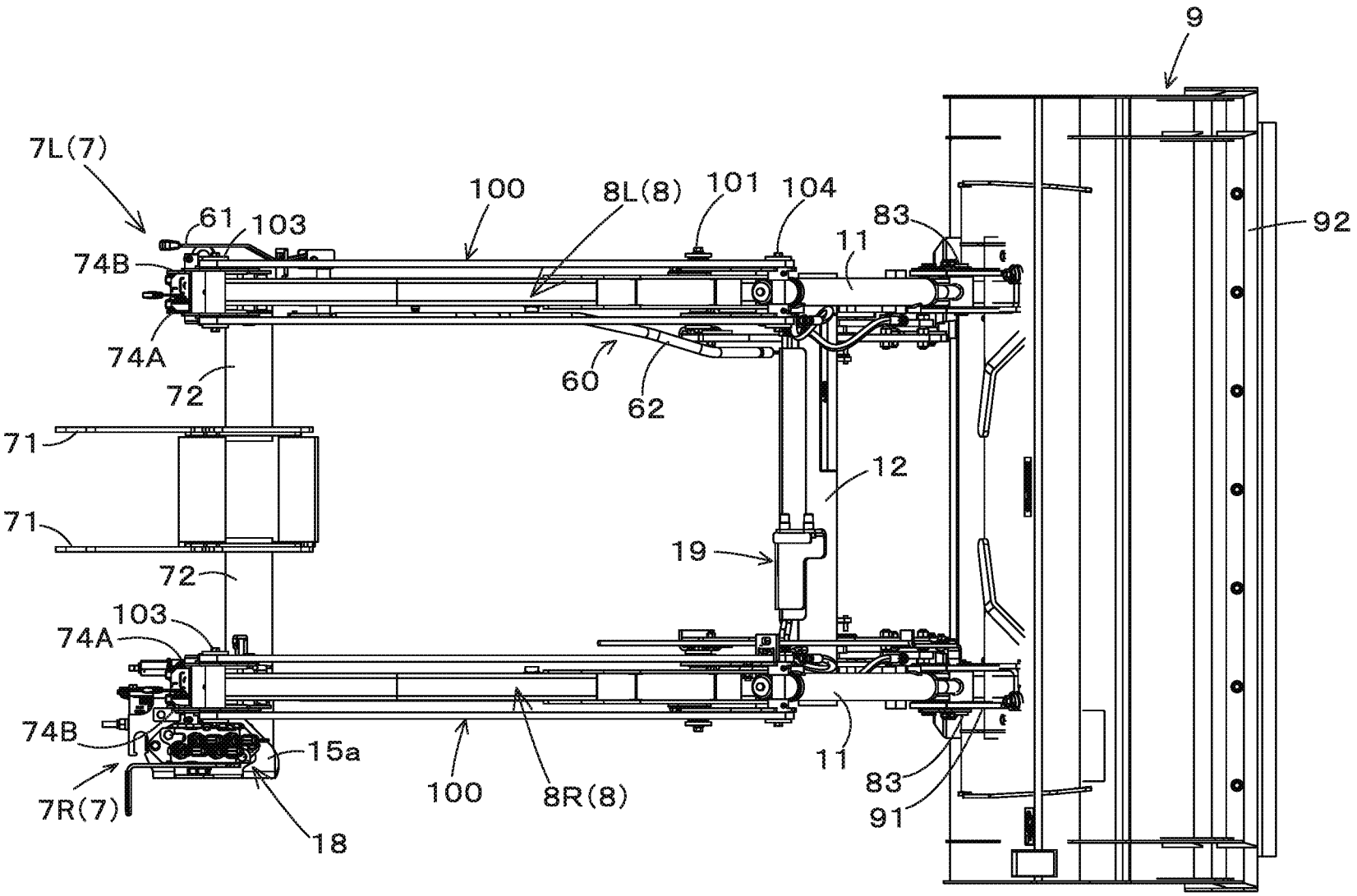
FIG. 4 is a plan view of the front loader according to the embodiment.

FIG. 2 to FIG. 4 are views illustrating one embodiment of the front loader 6. However, the front loader 6 is not limited to a front loader according to the embodiment as long as the link member interferes with the movement of the bucket (working tool) 9.

As shown in FIG. 2 to FIG. 4, the front loader 6 includes an attachment frame 7, a boom 8, a bucket 9, a boom cylinder 10, and a bucket cylinder 11.

The attachment frame 7 has a left frame 7L and a right frame 7R. The attachment frame 7 (the left frame 7L and the right frame 7R) has an attachment plate 71, a support body 72, a main frame 73, and a side frame 74.

The attachment plates 71 can be respectively attached to the left side of the vehicle body 2 and to the right side of the vehicle body 2. The attachment plate 71 of the left frame 7L can be attached to the left side of the vehicle body 2. The attachment plate 71 of the right frame 7R can be attached to the right side of the vehicle body 2.

The support members 72 protrude respectively toward the vehicle outward side from the left attachment plate 71 and the right attachment plate 71. The main frames 73 are respectively provided so as to extend upward from the end portions of the left support body 72 and the right support body 72 on the vehicle outward side.

The side frame 74 is detachably attached to the main frame 73. The side frame 74 extends upward from the main frame 73. The side frame 74 includes an inner side frame 74A and an outer side frame 74B. The inner side frame 74A is arranged on the vehicle inward side. The outer side frame 74B is arranged on the vehicle outward side.

A pivot shaft 13 extending in the vehicle width direction is provided on an upper portion of the side frame 74. The pivot shaft 13 extends through the inner side frame 74A and the outer side frame 74B in the vehicle width direction.

As shown in FIG. 3 and FIG. 4, the boom 8 has a left boom 8L and a right boom 8R. The left boom 8L is supported by the left frame 7L. The right boom 8R is supported by the right frame 7R. The middle portions of the left boom 8L and the middle portion of the right boom 8R are connected each other by a connector body 12.

The base end side of the boom 8 (the left boom 8L, the right boom 8R) is swingably supported around the pivot shaft 13 that is provided on the attachment frame 7 (a side frame 74). A pivot shaft 14 extending in the vehicle width direction is provided on the tip end side of the boom 8.

Hereinafter, for convenience of the description, the pivot shaft 14 is referred to as a "first pivot shaft 14", and the pivot shaft 13 is referred to as a "second pivot shaft 13". In addition, the direction in which the boom 8 extends is referred to as a "boom length direction", the direction extending from the base end side of the boom 8 toward the tip end side is referred to as a "boom forward direction", and the direction extending from the tip end side of the boom 8 toward the base end side is referred to as a "boom backward direction".

In the present embodiment, the boom 8 is formed to have a substantially rectangular tubular shape. In addition, the shape of the boom 8 is not limited to the substantially rectangular tubular shape, and may be another type of shape.

As shown in FIG. 2 to FIG. 4, the synchronous mechanism 60 is a mechanism configured to mainly hold a posture of the bucket 9 horizontally in the upward movement of the boom 8. In the synchronous mechanism 60, the bucket 9 performs the dumping operation in synchronization with the upward movement (the lifting operation) of the boom 8, and the bucket 9 performs the scooping operation in synchronization with the downward movement (the lowering operation) of the boom 8.

The synchronous mechanism 60 includes a link bar 61 provided on the base end side of the boom 8, a link member 62 arranged extending from the base end side of the boom 8 to the front end side so as to be movable back and forth downward from the base end side to the front end side of the boom 8, and a conversion lever 63 for converting the swinging of the link bar 61 into the forward and backward movement of the link member 62. The link bar 61 swings in synchronization with the upward and downward movement of the boom 8.

The tip end side of the link member 62 is rotatably attached to the bucket bracket 91 such that the bucket 9 can perform the scooping operation or the dumping operation with the link bar 61 swung, for example.

Note that the tip end side of the link member 62 may be attached to the bucket bracket 91 with a member such as a bracket.

As shown in FIG. 2 to FIG. 4, the boom 8 is provided with a stand 59. The stands 59 are respectively provided to the left boom 8L and the right boom 8R. The stand 59 extends in the boom length direction along each of the left boom 8L and the right boom 8R.

As shown in FIG. 4, the stand 59 is provided, on the tip end side of the boom 8, on the vehicle inward side of the left boom 8L and on the vehicle inward side of the right boom 8R. One end side (the tip side) of the stand 59 is pivotally supported by a lateral shaft. The lateral shaft is arranged on the vehicle inward side of the first pivot shaft 14, and is rotatable about the first pivot shaft 14.

As shown in FIG. 3, the other end side (the base end side) of the stand 59 is engaged with an engaging portion provided on a side plate of the boom 8 on the vehicle inner side at a middle portion of the boom 8 in the length direction. The stand 59 can be grounded together with the bucket 9 when the front loader 6 is detached from the tractor 1 by releasing the engaging on the other end side.

For convenience of the illustration, the stand 59 is omitted except in FIG. 2 to FIG. 4.

As shown in FIG. 2 to FIG. 4, the boom cylinder 10 connects the side frame 74 and the boom 8. One end portion (the base end portion) of the boom cylinder 10 is attached to the side frame 74. In particular, one end portion of the boom cylinder 10 is pivotally supported with a horizontal shaft 81 at a middle portion of the side frame 74 in the vertical direction. The other end portion (the tip end portion) of the boom cylinder 10 is attached to the boom 8.

In particular, the other end portion of the boom cylinder 10 is pivotally supported with a horizontal axis 82 at a middle portion of the boom 8 in the front-rear direction (the longitudinal direction). The boom 8 is swung upward around the second pivot shaft 13 by the stretching of the boom cylinder 10, and is swung downward around the second pivot shaft 13 by the shortening of the boom cylinder 10.

The boom cylinder 10 has a first port 10*a* provided on the bottom side and has a second port 10*b* provided on the rod side.

The boom cylinder 10 is controlled by a boom control valve 16 (see FIG. 1) to be described later. The boom control valve 16 is manually operated by an operation tool such as an operation lever.

In the embodiment, the working tool 9 is a bucket as shown in FIG. 2 to FIG. 4. However, the working tool 9 is not limited to a bucket, and may be another type of working tool.

The bucket (the working tool) 9 has a bucket body 92. The bucket body 92 is detachably attached to a bucket bracket (a working tool bracket) 91 with a connector member such as a pin. The bucket bracket 91 is supported swingably around the first pivot shaft 14.

The bucket main body 92 is a portion for scooping (containing) earth and sand and the like, and is attached to a front portion of the bucket bracket 91. The bucket bracket 91 and the bucket body 92 integrally rotate about the first pivot shaft 14.

The bucket cylinder (the working tool cylinder) 11 connects a swing arm 102 and a bucket bracket 91 to be described later. One end portion (the base end portion) of the bucket cylinder 11 is attached to the swing arm 102.

In particular, one end portion of the bucket cylinder 11 is pivotally supported on the upper portion of the swing arm 102 with the lateral axis.

The other end portion (the tip end portion) of the bucket cylinder 11 is attached to a bucket bracket 91.

In particular, the other end portion of the bucket cylinder 11 is pivotally supported on an upper portion of the bucket bracket 91 with the lateral shaft 83.

The bucket 9 performs the dumping operation (a first operation of the working tool) around the first pivot shaft 14 with the bucket cylinder 11 stretched, and performs the scooping operation (a second operation of the working tool) around the first pivot shaft 14 with the bucket cylinder 11 shortened. The bucket cylinder 11 has a third port 11*a* provided on the bottom side and has a fourth port 11*b* provided on the rod side.

The bucket cylinder 11 is controlled by a bucket control valve 17 (see FIG. 1) to be described later. The bucket control valve 17 is manually operated by the operation tool such as the operation lever.

As shown in FIG. 1, the front loader 6 may be provided with a third cylinder 40 in addition to the boom cylinder 10 and the bucket cylinder 11. The third cylinder 40 has a fifth port 40*a* provided on the bottom side thereof and has a sixth port 40*b* provided on the rod side thereof.

The third cylinder 40 performs the posture holding and a supplementary operation, for example. The third cylinder 40 is controlled by a third valve 20 (see FIG. 1) to be described later. The third valve 20 is manually operated by the operation tool such as the operation lever.

As shown in FIG. 2 to FIG. 4, the front loader 6 has an engaging link 100 arranged above and along the base end side of the boom 8, and has a swing arm 102 having a lower end side pivotally attached to the lower portion of a middle portion of the boom 8 in the front-rear direction so as to be rotatable about the lateral axis with a pivot shaft 101.

The base end portion of the engaging link 100 is attached pivotally around the lateral shaft with the pivot shaft 103 above the second pivot shaft 13 in the upper portion of the attachment frame 7. The tip end portion of the engaging link 100 is attached pivotally around the lateral shaft with the pivot shaft 104 above the lateral shaft pivotally supporting one end portion of the bucket cylinder 11 in the upper portion of the swing arm 102.

That is, one end portion (the base end portion) of the bucket cylinder 11 is pivotally attached below the pivot shaft 104 of the swing arm 102.

The front loader 6 includes a hydraulic circuit that is configured to control the boom cylinder 10 and the bucket cylinder 11. The hydraulic circuit controls the boom cylinder 10 and the bucket cylinder 11 based on the operation of an operation lever (not shown in the drawings).

As shown in FIG. 1, the hydraulic circuit has a hydraulic control valve 18 and a relief valve 19. The hydraulic circuit may control the third cylinder 40 described above in accordance with the operation of the operation lever (not shown in the drawings). The hydraulic circuit may have a third valve 20 for controlling the third cylinder 40.

As shown in FIG. 2 to FIG. 4, the hydraulic control valve 18 is attached to the middle portion of the side frame 74 (the side frame 74 of the right frame 7R in the present embodiment) in the vertical direction with the hydraulic control valve bracket 15*a*, for example.

As shown in FIG. 3 and FIG. 4, the relief valve 19 is attached to the middle portion of the connector body 12 in the vehicle width direction, for example.

As shown in FIG. 2, the third valve 20 is attached to a lower portion of the side frame 74 (the side frame 74 of the right frame 7R in the present embodiment) with the third valve bracket 15*b*, for example.

The hydraulic control valve 18 supplies the operation fluid to the boom cylinder 10 and the bucket cylinder 11 in accordance with the operation of the operation lever, and thus moves the boom 8 up and down and moves the bucket 9 to perform the dumping operation (the first operation) and the scooping operation (the second operation).

As shown in FIG. 1, the hydraulic control valve 18 includes a boom control valve 16 and a bucket control valve (a working tool control valve) 17.

The boom control valve 16 is configured to be manually switched between a lifting position 16*a*, a neutral position 16*b*, a lowering position 16*c*, and a floating position 16*d*. The bucket control valve 17 is configured to be manually switched between a dumping position (a first operation position) 17*a*, a neutral position 17*b*, a slow scooping position (a second operation position) 17*c*, and a scooping position (a quick scooping position, the second operation position) 17*d*.

The hydraulic control valve 18 includes a first fluid tube 21, a second fluid tube 22, a third fluid tube 23, and a fourth fluid tube 24.

The first fluid tube 21 is a fluid line for supplying and discharging the operation fluid to and from the boom cylinder 10 when the boom control valve 16 is at the lifting position 16*a* and the lowering position 16*c*. In particular, the first fluid tube 21 connects the first port 10*a* of the boom cylinder 10 to the boom control valve 16.

The second fluid tube 22 is a fluid line for supplying and discharging the operation fluid to and from the boom cylinder 10 when the boom control valve 16 is at the lifting position 16*a* and the lowering position 16*c*. In particular, the second fluid tube 22 connects the second port 10*b* of the boom cylinder 10 to the boom control valve 16.

The third fluid tube 23 is a fluid line for supplying and discharging the operation fluid to and from the bucket cylinder 11 when the bucket control valve 17 is at the dumping position 17*a* and the slow scooping position 17*c* (or at the dumping position 17*a* and the scooping position 17*d*). In particular, the third fluid tube 23 connects the third port 11*a* of the bucket cylinder 11 to the bucket control valve 17.

The fourth fluid tube 24 is a fluid line for supplying and discharging the operation fluid to and from the bucket cylinder 11 when the bucket control valve 17 is at the dumping position 17*a* and the slow scooping position 17*c* (or at the dumping position 17*a* and the scooping position 17*d*). In particular, the fourth fluid tube 24 connects the fourth port 11*b* of the bucket cylinder 11 to the bucket control valve 17.

The hydraulic control valve 18 has a fifth fluid tube 25 and a sixth fluid tube 26.

The fifth fluid tube 25 is a fluid line for connecting the boom control valve 16 and the bucket control valve 17, and for allowing the return oil, which is at least the operation fluid returning from the boom cylinder 10 to the boom control valve 16, to flow to the bucket control valve 17.

The sixth fluid tube 26 is a fluid line that is connected to the bucket control valve 17 and configured to allow the return oil, which is at least the operation fluid returning from the bucket cylinder 11 to the bucket control valve 17, to return to the operation fluid tank T.

In addition, the hydraulic control valve 18 has a pump P, the operation fluid tank T, a filter F, and a relief valve R.

The pump P is constituted of, for example, a fixed displacement gear pump to be driven by the power of the engine E1 of the working tool 1. The operation fluid tank T is a tank for storing the operation fluid. The filter F is arranged between the operation fluid tank T and the suction port of the pump P.

The relief valve R is a valve arranged between the output port of the pump P and the sixth fluid tube 26, and is configured to allow the operation fluid to flow from the output port of the pump P toward the sixth fluid tube 26 and block the operation fluid from flowing from the sixth fluid tube 26 toward the output port of the pump P.

In addition, the hydraulic control valve 18 includes a seventh fluid tube 27, an eighth fluid tube 28, a ninth fluid tube 29, and a tenth fluid tube 30.

The seventh fluid tube 27 is a fluid line for connecting the output port of the pump P and the boom control valve 16. The eighth fluid tube 28 is a fluid line that is branched from the seventh fluid tube 27 and is connected to the boom control valve 16 with the eighth check valve 28*a*. The eighth check valve 28*a* is a valve that is configured to allow the operation fluid to flow from the output port of the pump P toward the boom control valve 16 and to block the operation fluid from flowing from the boom control valve 16 toward the output port of the pump P.

The ninth fluid tube 29 is a fluid line for connecting the sixth fluid tube 26 and the boom control valve 16. The tenth fluid tube is a fluid line that is branched from the fifth fluid tube 25 and is connected to the bucket control valve 17 with the tenth check valve 30*a*. The tenth check valve 30*a* is a valve that is configured to allow the operation fluid to flow from the boom control valve 16 toward the bucket control valve 17 and to block the operation fluid from flowing from the bucket control valve 17 to the boom control valve 16.

The hydraulic control valve 18 includes a first bypass fluid tube 31 and a second bypass fluid tube 32.

The first bypass fluid tube 31 is a fluid line for connecting the first fluid tube 21 and the fourth fluid tube 24. The second bypass fluid tube 32 is a fluid line for connecting the second fluid tube 22 and the third fluid tube 23.

In addition, the hydraulic control valve 18 includes an outer fluid tube 33, an outer valve first fluid tube 34, and an outer valve second fluid tube 35.

The outer fluid tube 33 is a fluid line that supplies the operation fluid, which is supplied from the pump P, to an outer hydraulic device side of the hydraulic control valve 18 and is connected to the operation fluid tank T through the outer hydraulic device.

The outer valve first fluid tube 34 is a fluid line for supplying and discharging the operation fluid to and from a third valve 20 to be described later. In particular, the outer valve first fluid tube 34 connects the first port 20*a* of the third valve 20 to the seventh fluid tube 27.

The outer valve second fluid tube 35 is a fluid line for supplying and discharging the operation fluid to and from the third valve 20 to be described later. In particular, the outer valve second fluid tube 35 connects the second port 20*b* of the third valve 20 and the seventh fluid tube 27.

In the hydraulic control valve 18 having the configuration mentioned above, when the boom control valve 16 is switched to the lifting position 16*a*, the operation fluid from the pump P is supplied to the bottom side of the boom cylinder 10 through the seventh fluid tube 27, the eighth fluid tube 28, and the first fluid tube 21. And, the return fluid is returned to the boom control valve 16 side through the second fluid tube 22. As the result, the boom cylinder 10 is moved in a direction of lifting the boom 8.

When the boom control valve 16 is switched to the neutral position 16*b*, the operation fluid from the pump P is supplied to the bucket control valve 17 through the fifth fluid tube 25 and the tenth fluid tube 30. When the boom control valve 16 is switched to the lowering position 16*c*, the operation fluid from the pump P is supplied to the rod side of the boom cylinder 10 through the seventh fluid tube 27, the eighth fluid tube 28, and the second fluid tube 22, and the return fluid is returned to the boom control valve 16 side through the first fluid tube 21. As the result, the boom cylinder 10 is moved in a direction of lowering the boom 8.

When the boom control valve 16 is switched to the float position 16*d*, the first fluid tube 21 and the second fluid tube 22 are connected to the ninth fluid tube 29 and the sixth fluid tube 26. In addition, the discharge fluid tube includes the ninth fluid tube 29 and the sixth fluid tube 26.

In the hydraulic control valve 18 having the above-described configuration, when the bucket control valve 17 is switched to the dumping position 17*a*, the operation fluid from the pump P is supplied to the bottom side of the bucket cylinder 11 through the seventh fluid tube 27, the fifth fluid tube 25, the tenth fluid tube 30, and the third fluid tube 23, and the return fluid is returned to the bucket control valve 17 side through the fourth fluid tube 24. As the result, the bucket 9 performs the dumping operation (the first operation) with the bucket cylinder 11 moved.

When the bucket control valve 17 is switched to the neutral position 17*b*, the operation fluid from the pump P is supplied to the outer hydraulic device side through the outer fluid tube 33. When the bucket control valve 17 is switched to the slow scooping position 17*c*, the operation fluid from the pump P is supplied to the rod side of the bucket cylinder 11 more than the bottom side through the seventh fluid tube 27, the fifth fluid tube 25, the tenth fluid tube 30, the third fluid tube 23, and the fourth fluid tube 24. As the result, the bucket 9 performs the slow scooping operation (the second operation) with the bucket cylinder 11 moved.

When the bucket control valve 17 is switched to the scooping position 17*d*, the operation fluid from the pump P is supplied to the rod side of the bucket cylinder 11 through the seventh fluid tube 27, the fifth fluid tube 25, the tenth fluid tube 30, and the fourth fluid tube 24, and the return fluid is returned to the bucket control valve 17 side through the third fluid tube 23. As the result, the bucket 9 performs the scooping operation (the second operation) with the bucket cylinder 11 moved.

As shown in FIG. 1, the relief valve 19 includes a first relief valve 41 and a second relief valve 42.

The first relief valve 41 is a relief valve provided in the first bypass fluid tube 31 and configured to allow the operation fluid to flow from the fourth fluid tube 24 toward the first fluid tube 21 and to block the operation fluid from flowing from the first fluid tube 21 to the fourth fluid tube 24. The second relief valve 42 is a relief valve provided in the second bypass fluid tube 32 and configured to allow the operation fluid to flow from the third fluid tube 23 toward the second fluid tube 22 and to block the operation fluid from flowing from the second fluid tube 22 to the third fluid tube 23.

The third valve 20 is configured to supply the operation fluid to the third cylinder 40 in accordance with the operation of the operation lever, and operates the posture holding, for example.

As shown in FIG. 1, the third valve 20 includes a third control valve 50.

The third control valve 50 is configured to be manually switched between a shortening position 50*a*, a neutral position 50*b*, and a stretching position 50*c* in the manual operation.

The third valve 20 includes a third bottom side fluid tube 51 and a third rod side fluid tube 52.

The third bottom-side fluid tube 51 is a fluid line for supplying and discharging the operation fluid to and from the third cylinder 40 when the third control valve 50 is at the shortening position 50*a* and at the stretching position 50*c*. In particular, the third bottom side fluid tube 51 connects the fifth port 40*a* of the third cylinder 40 and the third control valve 50.

The third rod-side fluid tube 52 is a fluid line for supplying and discharging the operation fluid to and from the third cylinder 40 when the third control valve 50 is at the shortening position 50*a* and at the stretching position 50*c*. In particular, the third rod side fluid tube 52 connects the sixth port 40*b* of the third cylinder 40 and the third control valve 50.

In the third valve 20 having the above-described configuration, when the third control valve 50 is switched to the shortening position 50*a*, the operation fluid from the pump P is supplied to the rod side of the third cylinder 40 through the seventh fluid tube 27, the outer valve first fluid tube 34, and the third rod side fluid tube 52, and the return fluid is returned to the third control valve 50 side through the third bottom side fluid tube 51. As the result, the third cylinder 40 is moved in the shortening direction.

When the third control valve 50 is switched to the neutral position 16*b*, the operation fluid returns again to the seventh fluid tube 27 of the hydraulic control valve 18 through the outer valve second fluid tube 35 after the operation fluid from the pump P is supplied to the third control valve 50 through the seventh fluid tube 27 and the outer valve first fluid tube 34.

That is, in the seventh fluid tube 27 illustrated in FIG. 1, when the middle portion indicated by the dotted line is not in communication, the operation fluid from the pump P is supplied to the boom control valve 16 and the bucket control valve 17 through the seventh fluid tube 27, the outer valve first fluid tube 34, the third control valve 50 in the neutral position 16*b*, the outer valve second fluid tube 35, and the seventh fluid tube 27.

When the third control valve 50 is switched to the stretching position 50*c*, the operation fluid from the pump P is supplied to the bottom side of the third cylinder 40 through the seventh fluid tube 27, the outer valve first fluid tube 34, and the third bottom fluid tube 51, and the return fluid is returned to the third control valve 50 side through the third rod side fluid tube 52. As the result, the third cylinder 40 is moved in the stretching direction.

As for the operations of the boom 8 and the bucket 9, in particular, the state in which the boom 8 is lowered at the maximum scooping angle of the bucket 9 and the state in which the boom 8 is lowered at the maximum dumping angle of the bucket 9 will be described below.

When the boom 8 is to be lowered under the state where the bucket 9 is set to the fully-scooping state (the state in which the scooping angle is maximized), a force is applied in the direction of stretching the bucket cylinder 11. That is, the pressure of the operation fluid in the rod side of the bucket cylinder 11 increases (see FIG. 5 illustrating the inside of the rod side of the bucket cylinder 11).

Figure 5:
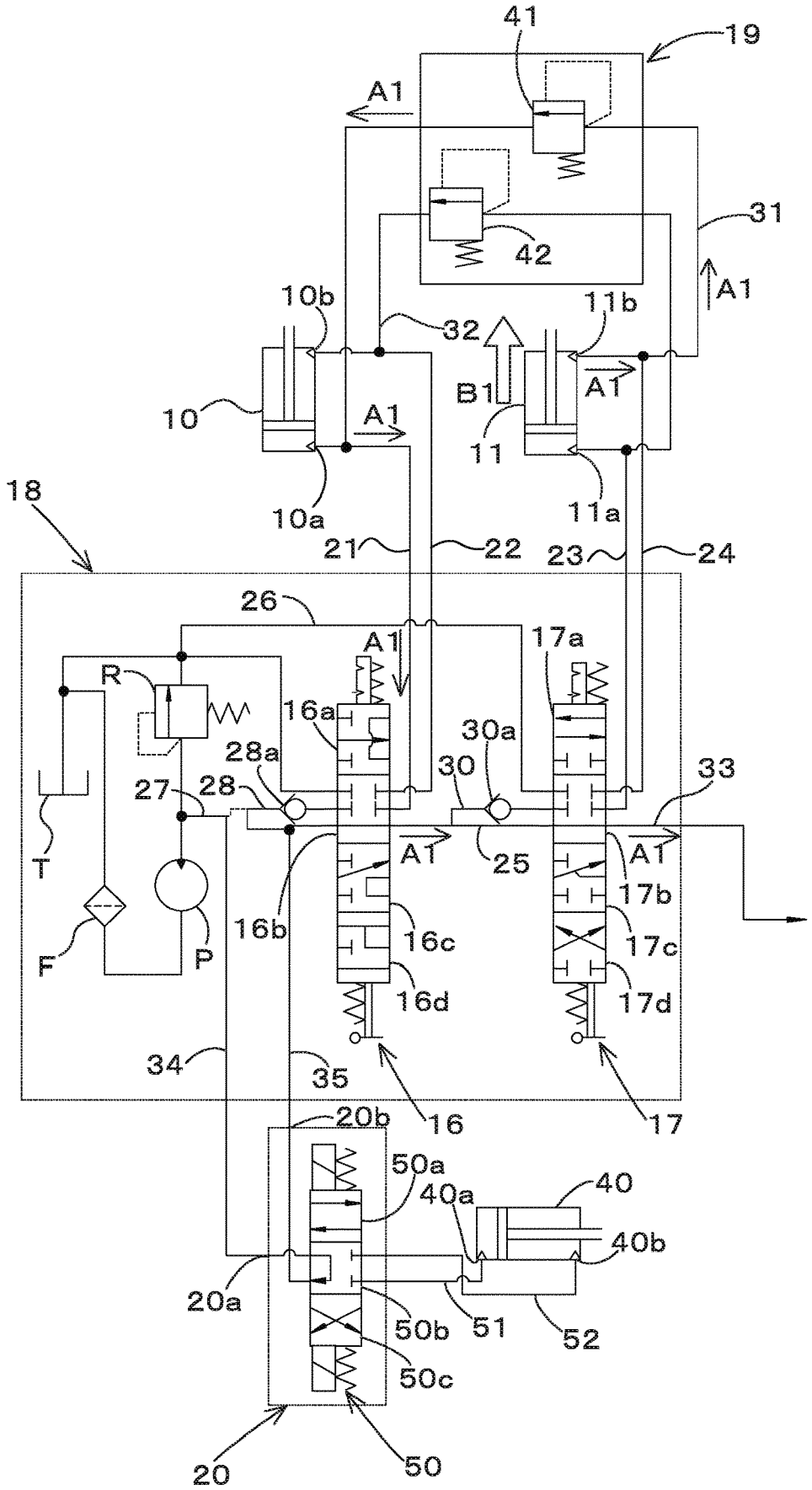
FIG. 5 is a circuit diagram showing a flow of operation fluid under a state where a boom is lowered at the maximum shoveling angle of a bucket according to the embodiment.

Accordingly, as shown in FIG. 5, the operation fluid in the rod side of the bucket cylinder 11 is applied to the first fluid tube 21 and the first port 10*a* of the boom cylinder 10 through the first bypass fluid tube 31 and the first relief valve 41 (refer to an arrowed line A1 in FIG. 5).

When the boom 8 is to be lowered under the state where the bucket 9 is set to the fully-dumping state (the state in which the dumping angle is maximized), a force is applied in the direction of shortening the bucket cylinder 11. That is, the pressure of the operation fluid in the bottom side of the bucket cylinder 11 increases (see FIG. 6 illustrating the inside of the bottom side of the bucket cylinder 11).

Figure 6:
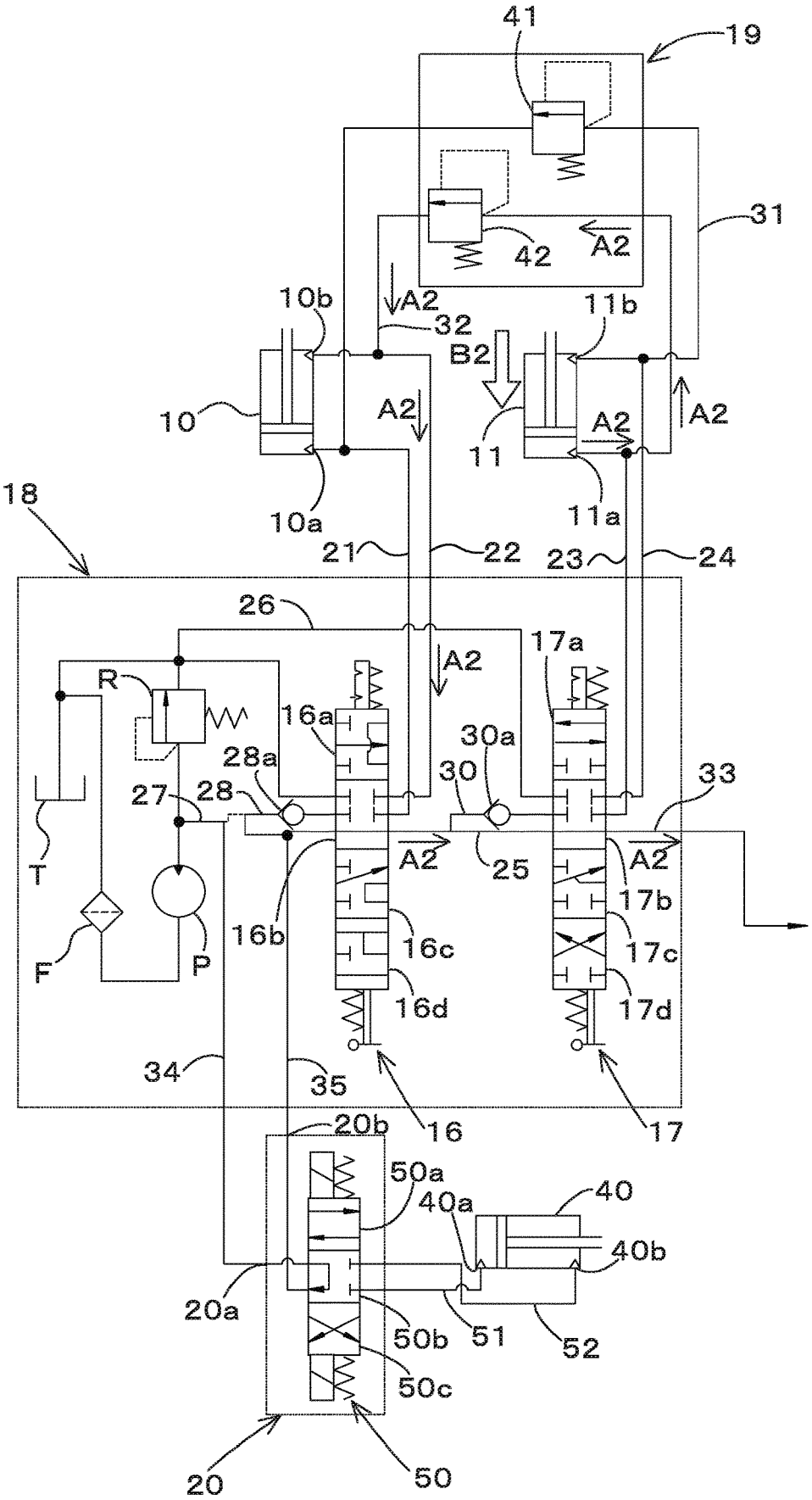
FIG. 6 is a circuit diagram showing a flow of operation fluid under a state where the boom is lowered at the maximum dumping angle of the bucket according to the embodiment.

Thus, as shown in FIG. 6, the operation fluid in the bottom side of the bucket cylinder 11 is applied to the second fluid tube 22 and the second port 10*b* side of the boom cylinder 10 through the second bypass fluid tube 32 and the second relief valve 42, and thus the operation fluid is applied in a direction of restricting the upward movement of the boom cylinder 10 (refer to an arrowed line A2 in FIG. 6). In other words, in the above-described hydraulic action, the force is applied in a direction (in a separate direction) opposite to the direction in which the tip end portion of the boom 8 and the bucket 9 approach each other.

In addition, the hydraulic circuit includes the third cylinder 40, the third control valve 50, the outer valve first fluid tube 34, the outer valve second fluid tube 35, the third bottom side fluid tube 51, and the third rod side fluid tube 52. However, the third cylinder 40 and the like is not required necessarily.

The operation of the hydraulic system for the working machine according to the embodiment described above will be described below.

A hydraulic system for the working machine 1, includes: the boom cylinder 10 to move the boom 8 upward and downward; the working tool cylinder 11 to move the working tool 9 attached to the boom 8; the boom control valve 16 configured to change a position of the boom cylinder 10 between a lifting position to allow the boom 8 to be lifted and a lowering position to allow the boom 8 to be lowered; the working tool control valve 17 configured to change a position of the working tool cylinder 11 between a first moving position to allow a first movement of the working tool 9 and a second moving position to allow a second movement of the working tool 9; the first fluid tube 21 through which operation fluid is supplied to and discharged from the boom cylinder 10 when the boom control valve 16 is at the lifting position and at the lowering position; the second fluid tube 22 through which operation fluid is supplied to and discharged from the boom cylinder 10 when the boom control valve 16 is at the lifting position and at the lowering position; the third fluid tube 23 through which operation fluid is supplied to and discharged from the working tool cylinder 11 when the working tool control valve 17 is at the first moving position 17*a* and at the second moving position 17*c*; the fourth fluid tube 24 through which operation fluid is supplied to and discharged from the working tool cylinder 11 when the working tool control valve 17 is at the first moving position 17*a* and at the second moving position 17*c*; the first bypass fluid tube 31 connecting the first fluid tube 21 and the fourth fluid tube 24; the second bypass fluid tube 32 connecting the second fluid tube 22 and the third fluid tube 23; the first relief valve 41 provided in the first bypass fluid tube 31 and configured to allow the operation fluid to flow from the fourth fluid tube 24 toward the first fluid tube 21 and to block the operation fluid flowing from the first fluid tube 21 toward the fourth fluid tube 24; and the second relief valve 42 provided in the second bypass fluid tube 32 and configured to allow the operation fluid to flow from the third fluid tube 23 toward the second fluid tube 22 and to block the operation fluid flowing from the second fluid tube 22 toward the third fluid tube 23.

According to the configuration, when the working tool 9 such as the bucket performs an operation of approaching the boom 8, the interference therebetween can be suppressed. For example, when the engaging link 100 for maintaining the posture of the working tool (the bucket) 9 is provided, it is possible to prevent the working tool 9 and the boom 8 from extremely approaching each other in operating the engaging link 100.

In addition, the boom cylinder 10 has: the first port 10*a* provided on a bottom side; and the second port 10*b* provided on a rod side. The working tool cylinder 11 has: the third port 11*a* provided on a bottom side; and the fourth port 11*b* provided on a rod side. The first fluid tube 21 connects the first port 10*a* and the boom control valve 16. The second fluid tube 22 connects the second port 10*b* and the boom control valve 16. The third fluid tube 23 connects the third port 11*a* and the working tool control valve 17. The fourth fluid tube 24 connects the fourth port 11*b* and the working tool control valve 17.

According to the configuration, the boom cylinder 10 and the working tool cylinder 11 can be smoothly stretched and shortened by the boom control valve 16 and the working tool control valve 17.

In addition, the hydraulic system includes the fifth fluid tube 25 connecting the boom control valve 16 and the working tool control valve 17 and being configured to allow return fluid to flow toward the working tool control valve 17, the return fluid being operation fluid at least returning from the boom cylinder 10 to the boom control valve 16.

According to the configuration, the return fluid flowing when the boom cylinder 10 is stretched and shortened can be supplied to the working tool control valve 17, and thereby allowing also a combined operation of the boom cylinder 10 and the working tool cylinder 11.

In addition, the hydraulic system includes the sixth fluid tube 26 connected to the working tool control valve 17 and being configured to allow return fluid to return to the operation fluid tank T, the return fluid being operation fluid at least returning from the working tool cylinder 11 to the working tool control valve 17.

According to the configuration, the working tool cylinder 11 can be stretched and shortened smoothly.

In addition, the boom control valve 16 is configured to take a floating position 16*d* that allows the first fluid tube 21 and the second fluid tube 22 to be connected to a discharge fluid tube (the sixth fluid tube 26, the ninth fluid tube 29).

According to the configuration, when the boom control valve 16 has the floating position 16*d*, the working tool 9 and the like can follow the unevenness of the road surface due to its own weight.

The hydraulic system and the working machine include the working tool bracket 91 to which the working tool 9 is detachably attached. The working tool bracket 91 is coupled to a tip end of the boom 8 and to a tip end of the working tool cylinder 91. According to the configuration, in the case where the working tool and the working tool cylinder are not connected with the link mechanism, the interference between the working tool such as a bucket and the boom side can be prevented.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:

a boom cylinder to move a boom upward and downward;

a working tool cylinder to move a working tool attached to the boom;

a boom control valve configured to change a position of the boom cylinder between a lifting position to allow the boom to be lifted and a lowering position to allow the boom to be lowered;

a working tool control valve configured to change a position of the working tool cylinder between a first moving position to allow a first movement of the working tool and a second moving position to allow a second movement of the working tool;

a first fluid tube through which operation fluid is supplied to and discharged from the boom cylinder when the boom control valve is at the lifting position and at the lowering position;

a second fluid tube through which operation fluid is supplied to and discharged from the boom cylinder when the boom control valve is at the lifting position and at the lowering position;

a third fluid tube through which operation fluid is supplied to and discharged from the working tool cylinder when the working tool control valve is at the first moving position and at the second moving position;

a fourth fluid tube through which operation fluid is supplied to and discharged from the working tool cylinder when the working tool control valve is at the first moving position and at the second moving position;

a first bypass fluid tube connecting the first fluid tube and the fourth fluid tube;

a second bypass fluid tube connecting the second fluid tube and the third fluid tube;

a first relief valve provided in the first bypass fluid tube and configured to allow the operation fluid to flow from the fourth fluid tube toward the first fluid tube and to block the operation fluid flowing from the first fluid tube toward the fourth fluid tube; and a second relief valve provided in the second bypass fluid tube and configured to allow the operation fluid to flow from the third fluid tube toward the second fluid tube and to block the operation fluid flowing from the second fluid tube toward the third fluid tube.

2. The hydraulic system according to claim 1, wherein the boom cylinder has:

a first port provided on a bottom side; and a second port provided on a rod side, wherein the working tool cylinder has:

a third port provided on a bottom side; and a fourth port provided on a rod side, wherein the first fluid tube connects the first port and the boom control valve, wherein the second fluid tube connects the second port and the boom control valve, wherein the third fluid tube connects the third port and the working tool control valve, and wherein the fourth fluid tube connects the fourth port and the working tool control valve.

3. The hydraulic system according to claim 2, comprising a fifth fluid tube connecting the boom control valve and the working tool control valve and being configured to allow return fluid to flow toward the working tool control valve, the return fluid being operation fluid at least returning from the boom cylinder to the boom control valve.

4. The hydraulic system according to claim 3, comprising a sixth fluid tube connected to the working tool control valve and being configured to allow return fluid to return to an operation fluid tank, the return fluid being operation fluid at least returning from the working tool cylinder to the working tool control valve.

5. The hydraulic system according to claim 4, wherein the boom control valve is configured to take a floating position that allows the first fluid tube and the second fluid tube to be connected to a discharge fluid tube.

6. The hydraulic system according to claim 3, wherein the boom control valve is configured to take a floating position that allows the first fluid tube and the second fluid tube to be connected to a discharge fluid tube.

7. The hydraulic system according to claim 2, wherein the boom control valve is configured to take a floating position that allows the first fluid tube and the second fluid tube to be connected to a discharge fluid tube.

8. The hydraulic system according to claim 1, comprising a fifth fluid tube connecting the boom control valve and the working tool control valve and being configured to allow return fluid to flow toward the working tool control valve, the return fluid being operation fluid at least returning from the boom cylinder to the boom control valve.

9. The hydraulic system according to claim 8, comprising a sixth fluid tube connected to the working tool control valve and being configured to allow return fluid to return to an operation fluid tank, the return fluid being operation fluid at least returning from the working tool cylinder to the working tool control valve.

10. The hydraulic system according to claim 9, wherein the boom control valve is configured to take a floating position that allows the first fluid tube and the second fluid tube to be connected to a discharge fluid tube.

11. The hydraulic system according to claim 8, wherein the boom control valve is configured to take a floating position that allows the first fluid tube and the second fluid tube to be connected to a discharge fluid tube.

12. The hydraulic system according to claim 1, wherein the boom control valve is configured to take a floating position that allows the first fluid tube and the second fluid tube to be connected to a discharge fluid tube.

13. The hydraulic system according to claim 1, comprising a working tool bracket to which the working tool is detachably attached, wherein the working tool bracket is coupled to a tip end of the boom and to a tip end of the working tool cylinder.

14. A working machine comprising the hydraulic system according to claim 1.

* * * * *